United States Patent [19]

Lesavage

[11] 4,348,822

[45] Sep. 14, 1982

[54] SNOWSHOE FOOTWEAR

[76] Inventor: Stephen J. Lesavage, 150 Robindale Rd., Winnipeg, Manitoba, Canada, R3R 1G7

[21] Appl. No.: 221,926

[22] Filed: Dec. 31, 1980

[30] Foreign Application Priority Data

Jan. 17, 1980 [CA] Canada ..... 344212

[51] Int. Cl.[3] ..... A43B 5/04

[52] U.S. Cl. ..... 36/122

[58] Field of Search ..... 36/122, 123, 124, 125, 36/25 R

[56] References Cited

U.S. PATENT DOCUMENTS 2,516,238 7/1950 Mortsell ..... 36/122

FOREIGN PATENT DOCUMENTS 28843 2/1907 Austria ..... 36/122

*Primary Examiner*—Patrick D. Lawson

*Attorney, Agent, or Firm*—Stanley G. Ade

[57] ABSTRACT

The attachment straps for snowshoes usually require a buckle type strap or tied construction which is difficult to retain over the toe of the boot or shoe during use. Tabs sewn to the side of moccasins are used to retain the straps but these are not usable with other types of footwear such as boots and the like. In one embodiment of the invention, the sole is widened out at the area of strap engagement and provided with vertically situated closed ended slots through which the straps engage thus holding the footwear in the desired position relative to the snowshoe. The preferred embodiment utilizes similar slots but opening out onto the periphery of the enlarged sole portion so that the strap can be engaged and disengaged without buckling. This also permits a closed elasticized strap to be used as it can be engaged and disengaged and snapped into position over the instep or vamp area of the boot or shoe.

7 Claims, 3 Drawing Figures

SNOWSHOE FOOTWEAR

BACKGROUND OF THE INVENTION

When using showshoes, it is necessary to retain the snowshoe in position relative to the toe portion of the footwear in such a manner that the foot of the user can pivot readily and easily yet at the same time retain the snowshoe in position upon the toe area so that it does not become disengaged during use.

Experienced showshoe operators have little difficulty in retaining the snowshoes in position by means of loops adjacent the toe areas of the snowshoes but unexperienced persons often "walk out" of the snowshoes particularly when they are being used in rough surfaced or deep snow conditions.

Attempts have been made to detachably retain the footwear in position upon the snowshoe yet at the same time permit the desired freedom of action and one example known to the applicant comprises vertically situated tabs secured to the sides of footwear such as a moccasin, through which the straps engage. An example of this method is shown in U.S. Pat. No. 3,965,584 issued to Maurice Beaulieu.

Unfortunately, although this method is satisfactory for use with moccasins or moccasin type footwear, it is not particularly usable with heavy duty insulated footwear such a boot with a rubber sole which is often used instead of conventional moccasins, particularly in extreme cold conditions or conditions where excessively moist snow may be found.

The vamp area of a moccasin includes a vertically situated peripheral wall formed on or as a continuation of the sides of the sole which are particularly suited for use with this type of vertical loop.

The present invention overcomes difficulties inherent with such fastening means particularly when same is used on a relatively heavy rubber soled leather boot or the like and in accordance with the invention there is provided detachable fastening means for securing the snowshoes to the boot or shoe; means on said boot or shoe to detachably retain the fastening means onto the sole of the boot or shoe, said means including a planar portion of the sole extending beyond the welt of the boot or shoe adjacent the fastening area and an elongated slot formed vertically through the planar portion to detachably receive and retain the fastening means in position relative to the boot or shoe.

An advantage of the present invention is that the slots may be formed vertically through a widened extension of the sole and may either be of the closed loop type or an open looped type, the latter facilitating engagement and disengagement of the fastening straps.

Another advantage of the present invention, particularly when used with the open slot type, is that a closed loop resilient strap may be used which is easily engaged within the slots and then snapped over the vamp area to detachably secure the snowshoes to the toes of the footwear.

Still another advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention in which:

DESCRIPTION OF THE DRAWINGS

In the drawings like characters of reference indicate corresponding parts in the different figures.

DETAILED DESCRIPTION

Figure 1:
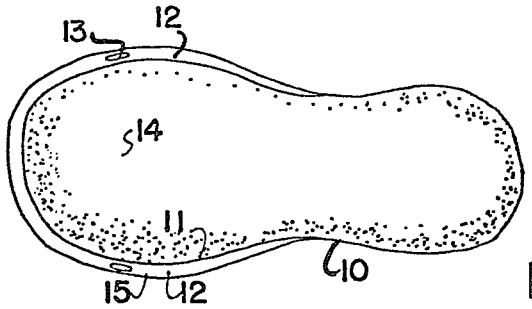
FIG. 1 is a plan schematic view of one embodiment of the invention with the upper portion of the boot being removed for clarity.
Figure 2:
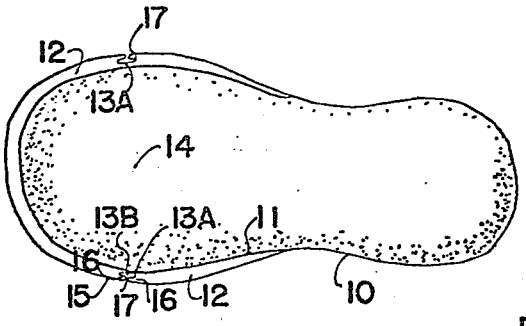
FIG. 2 is a view similar to FIG. 1 but showing the preferred embodiment.

Proceeding therefore to describe the invention in detail, reference should first be made to FIGS. 1 and 2 in which 10 illustrates the outline or profile of the boot or shoe and 11 the welt area, particularly around the front sole portion. The sole 12 is widened out around the front sole portion as clearly shown thus presenting a planar extension outboard of the welt line 11.

In FIG. 1, enlongated closed ended slots 13 are formed through the planar sections 12 adjacent the welt area 14, said slots running substantially parallel to the longitudinal axis of the sole.

Figure 3:
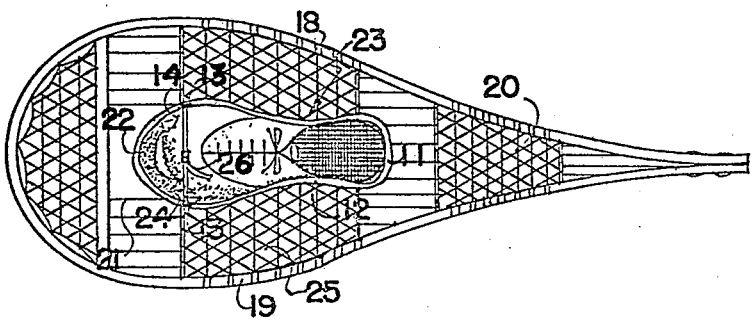
FIG. 3 is a plan view of a snowshoe with a boot or shoe engaged within the fastening means and utilizing one embodiment of the invention.

In the preferred embodiment shown in FIG. 2, these slots identified by reference character 13A open out onto the outer perimeter 15 of the planar portion 12 so that the slots 13A communicates with the outer perimeter as clearly illustrated, thus preventing a substantially T-shaped slot when viewed in plan with the stem of the T opening out onto the perimeter 15 and it will be noted that the distance between the portions 16 of the slot entrance, identified by reference character 17, is considerably narrower than the fore and aft length of the main portion 13B of the slot thus facilitating engagement and disengagement of the fastening means as will hereinafter be described. FIG. 3 shows a conventional showshoe 18 consisting of the perimetrical frame 19 and the tail portion 20. The web opening 21 defines the position of the toe area 22 of the boot or shoe collectively designated 23, when same is in the correct position as illustrated in FIG. 3. The fastening means, in FIG. 3, takes the form of an elongated flexible strap 24 which engages through the webbing 25 of the snowshoe and over the vamp area 14 of the boot or shoe 23 with the ends of the strap passing through the slots 13 or 13A and being secured by conventional fastening means 26 such as a buckle assembly or, alternatively, a tie assembly (not illustrated).

This enables convenient fastening means to be incorporated in relatively heavy duty and well insulated boot constructions conventionally used in cold climates.

If the embodiment shown in FIG. 2 is used, then the fastening means shown in FIG. 3 can, of course, also be used. Under these circumstances, once the fastening means has been loosened, it is merely necessary to turn same sideways so that it may be fed through the openings 17 of the slots thus disengaging same from the boot sole planar portions.

However, it also permits a closed fastening means to be used which may take the form of ties or buckles more or less permanently fastened but preferably they can be used with a closed loop fastening means such as a resilient strap. These may be engaged through the opening 17 and into the slot 13B whereupon the upper portion may be snapped over the vamp area 14 thus making attachment and detachment from the showshoes from the boot, relatively easy particularly when contrasted with conventional fastening means.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. In a boot or shoe which includes a sole, for use with snowshoes, said snowshoes including detachable fastening means for securing the snowshoes to the boot or shoe; means on said boot or shoe to detachably retain the fastening means onto the sole of the boot or shoe, said means including a planar portion of the sole extending beyond the welt of the boot or shoe adjacent the fastening area and an elongated slot formed vertically through the planar portion to detachably receive and retain the fastening means in position relative to the boot or shoe.

2. The invention according to claim 1 in which the slot is closed ended.

3. The invention according to claim 1 in which the slot opens out onto the outer edge of the planar portion, the width of the portion of the slot opening, opening out onto the edge of the planar portion being narrower than the length of the slot through the planar portion.

4. The invention according to claim 3 in which the slot is substantially T-shaped when viewed in plan with the step of the T-shape opening out onto to the outer edge of the planar portion.

5. The invention according to claims 1, 2 or 3 in which the fastening means comprises an elongated flexible strap component engaging the snowshoe and the means on the boot or shoe, and detachable closure means on the end of said strap component cooperating together to datachably secure the ends together over the vamp area of the boot or shoe.

6. The invention according to claim 4 in which the fastening means comprises an elongated flexible strap component engaging the snowshoe and the means on the boot or shoe, and detachable closure means on the end of said strap component cooperating together to detachably secure the ends together over the vamp area of the boot or shoe.

7. The invention according to claims 3 or 4 in which said fastening means comprises an elongated flexible and resilient closed loop member engaging the snowshoe and detachably engaging the slots in the planar portion of the sole of the boot or shoe and snap engaging over the vamp area of the boot or shoe.

* * * * *